US008858875B2

(12) United States Patent
Ueyama et al.

(10) Patent No.: US 8,858,875 B2
(45) Date of Patent: Oct. 14, 2014

(54) NICKEL BASED ALLOY MATERIAL

(75) Inventors: Masaki Ueyama, Amagasaki (JP); Masaaki Terunuma, Osaka (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 142 days.

(21) Appl. No.: 13/422,092

(22) Filed: Mar. 16, 2012

(65) Prior Publication Data

US 2012/0195790 A1 Aug. 2, 2012

Related U.S. Application Data

(63) Continuation of application No. PCT/JP2010/065959, filed on Sep. 15, 2010.

(30) Foreign Application Priority Data

Sep. 18, 2009 (JP) ..... 2009-216702

(51) Int. Cl.
*C22C 19/05* (2006.01)

(52) U.S. Cl.
USPC ..... 420/445; 420/443; 420/453; 420/457; 420/458

(58) Field of Classification Search
USPC ..... 420/443, 445, 453, 457, 458
See application file for complete search history.

(56) References Cited

U.S. PATENT DOCUMENTS

| | | | | |
|---|---|---|---|---|
| 6,623,869 | B1 * | 9/2003 | Nishiyama et al. | 428/685 |
| 8,501,086 | B2 * | 8/2013 | Ueyama et al. | 420/445 |

FOREIGN PATENT DOCUMENTS

| | | |
|---|---|---|
| CA | 2 717 380 | 10/2009 |
| CN | 1977058 | 6/2007 |
| CN | 1977060 | 6/2007 |
| EP | 1 717 330 | 11/2006 |
| JP | 61-170554 | 8/1986 |
| JP | 61-201759 | 9/1986 |
| JP | 05-195126 | 8/1993 |
| JP | 05-247597 | 9/1993 |
| JP | 06-128699 | 5/1994 |
| JP | 08-003666 | 1/1996 |
| JP | 08-252692 | 10/1996 |
| JP | 10-060603 | 3/1998 |
| JP | 11-080902 | 3/1999 |
| JP | 2001-107196 | 4/2001 |
| JP | 2002-096111 | 4/2002 |
| JP | 2002-096171 | 4/2002 |
| JP | 2004-019005 | 1/2004 |
| WO | 2009/119630 | 10/2009 |

* cited by examiner

*Primary Examiner* — Jessee Roe
(74) *Attorney, Agent, or Firm* — Clark & Brody

(57) ABSTRACT

A Ni based alloy material consists of by mass percent, C≤0.03%, Si: 0.01 to 0.5%, Mn: 0.01 to 1.0%, P≤0.03%, S≤0.01%, Cr: not less than 20% to less than 30%, Ni: more than 40% to not more than 50%, Cu: more than 2.0% to not more than 5.0%, Mo: 4.0 to 10%, Al: 0.005 to 0.5%, W: 0.1 to 10%, N: more than 0.10% to not more than 0.35%, optionally one or more elements selected from Ca≤0.01% and Mg≤0.01%, with the balance being Fe and impurities, and the formula of "0.5Cu+Mo≥6.5" is satisfied. The material has a surface hardness of a Vickers hardness of not less than 350 at 500° C., a corrosion resistance equivalent to that of Ni based alloys having high Mo contents, and excellent erosion resistance in a severe environment.

2 Claims, No Drawings

NICKEL BASED ALLOY MATERIAL

This application is a continuation of the international application PCT/JP2010/065959 field on Sep. 15, 2010, the entire content of which is herein incorporated by reference.

TECHNICAL FIELD

The present invention relates to a Ni based alloy material. Specifically, the present invention relates to a Ni based alloy material which has an excellent corrosion resistance in an erosion environment at a temperature from 100 to 500° C. where high hardness substances containing chlorides and sulfides are flying about, and an environment where hydrochloric acid corrosion and sulfuric acid corrosion occur. More specifically, the present invention relates particularly to a highly corrosion-resistant Ni based alloy material which can be suitably used as a material for various kinds of structural members, such as those of economizers of heavy oil fired boilers used in petroleum refineries, petrochemical plants and the like as well as those of flue gas desulfurization equipment, flues, smokestacks and the like in thermal power stations. The "erosion" mentioned above refers to the degradation of material due to mechanical action.

BACKGROUND ART

In economizers of heavy oil fired boilers used in petroleum refineries, petrochemical plants and the like as well as flue gas desulfurization equipment used in thermal stations and so on, combustion ashes and the like having a high hardness are generated, causing a problem of thickness reduction in the material used due to erosion. For this reason, it is conventionally a common practice in such an environment to use a low alloy steel in view of surface hardness in order to ensure erosion resistance by its scale, or to spray a high-hardness alloy on the material surface in order to ensure erosion resistance as shown in the Patent Documents 1 and 2.

On the other hand, in recent years, as a highly corrosion resistant alloy, there have been used Ni based alloys having a markedly excellent corrosion resistance to sulfuric acid in comparison with Fe based alloys. Concretely, commercial Ni based alloys containing Cr, Mo and W with 20% Cr-15% Mo-4% W as a basic chemical composition, such as Hastelloy C22 and Hastelloy C276 ("Hastelloy" is a trademark), the Ni based alloy containing 16 to 27% of Cr, 16 to 25% of Mo and 1.1 to 3.5% of Ta which is disclosed in the Patent Document 3 and so on have been used.

In addition, for example, in the Patent Documents 4 to 6, austenitic alloys used in waste incinerators and the like are disclosed. An austenitic stainless steel for flue-gas desulfurization equipment and for seawater service, which is excellent in crevice corrosion resistance and hot workability, is disclosed in the Patent Document 7. Moreover, austenitic stainless steels excellent in high temperature corrosion resistance, which are suitable for seawater service and for heat exchangers of incinerators, are disclosed in the Patent Documents 8 and 9.

Further, an austenitic steel welded joint and a welding material, which are excellent in resistance to weld cracking and corrosion resistance to sulfuric acid, are disclosed in the Patent Document 10. Moreover, in the Patent Document 11, a Ni—Cr—Mo—Cu alloy excellent in corrosion resistance to sulfuric acid and wet-treated phosphoric acid is disclosed.

CITATION LIST

Patent Documents

Patent Document 1: JP 61-170554 A
Patent Document 2: JP 11-80902 A
Patent Document 3: JP 8-3666 A
Patent Document 4: JP 5-195126 A
Patent Document 5: JP 6-128699 A
Patent Document 6: JP 5-247597 A
Patent Document 7: JP 10-60603 A
Patent Document 8: JP 2002-96111 A
Patent Document 9: JP 2002-96171 A
Patent Document 10: JP 2001-107196 A
Patent Document 11: JP 2004-19005 A

SUMMARY OF THE INVENTION

Problems to be Solved by the Invention

Although a low alloy steel, which are used in an environment where combustion ashes having a high hardness are flying about and corrosion due to hydrochloric acid and sulfuric acid produced from chlorides and sulfides contained in the combustion ashes occurs, can prevent erosion with its high-hardness surface scale, it does not have sufficient corrosion resistance to hydrochloric acid corrosion and sulfuric acid corrosion.

Furthermore, the surface film obtained by spraying tends to be porous; and therefore, it does not provide sufficient corrosion resistance in the above-described environment.

On the other hand, Ni based alloys, such as Hastelloy C276 which is a highly corrosion-resistant alloy, are improved in their corrosion resistance by the addition of elements such as Cr, Mo and the like to stabilize a passive film. Those alloys, therefore, can only produce a thin film, which although is very fine-structured, on their surfaces and thus they do not have a sufficient erosion resistance. Although solid solution hardening by adding carbon and/or nitrogen is effective as a method of increasing hardness, when the content of Ni is large, a problem arises in that the microstructure becomes unstable, or the workability deteriorates due to the decrease in solubility of such elements. For this reason, it has not been possible to apply a method which utilizes the solid solution hardening of carbon and/or nitrogen.

Corrosion resistance in environments containing chlorides was only considered in each of the alloys and steels proposed in the Patent Documents 4 to 9, and no study has been carried out as to the application thereof to an erosion environment or a severe corrosive environment where reducing acids are generated such as hydrochloric acid corrosion and sulfuric acid corrosion.

Furthermore, in the case of the materials proposed in the Patent Documents 10 and 11 as well, no study has been carried out as to the erosion resistance, and a corrosion resistance including that to hydrochloric acid.

In view of the above-mentioned state of affairs, the present invention has been accomplished. It is an object of the present invention to provide a Ni based alloy material which can ensure corrosion resistance equivalent to that of Ni based alloys having high Mo contents, such as Hastelloy C22 and Hastelloy C276, and further can prevent the occurrence of erosion owing to a high surface hardness, in a severe environment at a temperature from 100 to 500° C. where erosion, hydrochloric acid corrosion, and sulfuric acid corrosion occur.

Means for Solving the Problems

In order to accomplish the above-described objective, the present inventors made various studies and experiments. As a result, the present inventors first obtained the following findings (a) and (b).

(a) In an environment containing reducing acids, such as hydrochloric acid and sulfuric acid, usually, a passive film is not formed in a stable manner on the surface of a Ni based alloy and, therefore, the alloy is subjected to general corrosion. However, in the case of an alloy with raised contents of Ni and Mo, such as Hastelloy C22 and Hastelloy C276, corrosion resistance is improved owing to the restriction of dissolution of the alloy itself and the formation of a thin and fine-structured passive film on the surface thereof.

(b) Increasing the Ni content of a Ni based alloy will decrease the solubility of N in the matrix, thereby disabling the application of solid solution hardening utilizing N. On the other hand, increasing the Mo content of a Ni based alloy results in not only cost increases, but also deterioration in weldability and workability, since intermetallic compounds such as a sigma phase and so on may sometimes be formed due to the segregation of Mo.

Accordingly, the present inventors have investigated an appropriate Ni content for ensuring the solubility of N in the matrix and, in addition to that, have conducted a study on a Ni based alloy which can ensure a corrosion resistance equivalent to that of Ni based alloys having high Ni and Mo contents, such as Hastelloy C22 and Hastelloy C276, as well as a high hardness in a temperature range of 100 to 500° C., in particular at 500° C., by combining with other elements, while controlling the content of Mo to not more than 10% by mass percent to increase workability. As a result, the inventors obtained the following findings (c) to (e).

(c) By including Cu, it is possible to make a thin and fine-structured passive film to be formed on the surface of a Ni based alloy.

(d) By controlling the content of Ni to be more than 40% to not more than 50%, it is possible to increase the content of N, thereby promoting solid solution hardening and work hardening.

(e) By including an appropriate amount of W, it is possible to promote solid solution hardening and work hardening without causing the deterioration of weldability and workability. Furthermore, by cold working, it is possible to easily ensure a surface hardness of a Vickers hardness (hereafter, also referred to as an "HV hardness") of 350 at 500° C.

Therefore, in order to decrease a cost, the present inventors have further carried out a study on the corrosion resistance to sulfuric acid and the corrosion resistance to hydrochloric acid by using various Ni based alloys with a base composition of Ni—Cr—Cu—Mo, which contain, by mass percent, not less than 20% to less than 30% of Cr, and Cu and Mo. As a result, the present inventors obtained the following important finding (f).

(f) By ensuring not only that the Mo and Cu contents are individually controlled, but also that the contents of these elements satisfy the following formula (1);

$$0.5Cu+Mo \geq 6.5 \quad (1),$$

it is possible to ensure excellent corrosion resistance in an environments containing both sulfuric acid and hydrochloric acid. Wherein, each element symbol in the formula (1) represents the content by mass percent of the element concerned.

The present invention has been completed based on the basis of the findings described above.

The main points of the present invention are the Ni based alloy materials shown in the following [1] and [2].

[1] A Ni based alloy material, having a chemical composition which consists of by mass percent, C: not more than 0.03%, Si: 0.01 to 0.5%, Mn: 0.01 to 1.0%, P: not more than 0.03%, S: not more than 0.01%, Cr: not less than 20% to less than 30%, Ni: more than 40% to not more than 50%, Cu: more than 2.0% to not more than 5.0%, Mo: 4.0 to 10%, Al: 0.005 to 0.5%, W: 0.1 to 10% and N: more than 0.10% to not more than 0.35%, with the balance being Fe and impurities, and the following formula is satisfied, $$0.5Cu+Mo \geq 6.5 \quad (1);$$

and further, having a surface hardness of a Vickers hardness of not less than 350 at 500° C.;

wherein, each element symbol in the formula (1) represents the content by mass percent of the element concerned.

[2] The Ni based alloy material according to the above [1], which further contains, by mass percent, one or more elements selected from Ca: not more than 0.01% and Mg: not more than 0.01% in lieu of a part of Fe.

The "impurities" in the term of "Fe and impurities" as the balance refers to components which are mixed into from raw materials such as ore and scrap and due to various factors in the manufacturing process when the Ni based alloy material is industrially manufactured, and which are permitted within a range not to adversely affect the present invention.

The above-mentioned inventions [1] and [2] related to the Ni based alloy materials are referred to as "the present invention [1]" and "the present invention [2]", respectively, or collectively referred to as "the present invention".

Effects of the Invention

The Ni based alloy material of the present invention has a corrosion resistance equivalent to that of Ni based alloys having high Mo contents, such as Hastelloy C22 and Hastelloy C276, in a severe environment where hydrochloric acid corrosion and sulfuric acid corrosion occur, together with excellent workability. Further, the Ni based alloy material also has an excellent erosion resistance since it has a high surface hardness owing to the solid solution hardening of N and cold working. For this reason, the said Ni based alloy material can be suitably used as a low-cost material for various kinds of structural members, such as those of economizers of heavy oil fired boilers as well as those of flue gas desulfurization equipment, flues, smokestacks and the like in thermal power stations.

MODES FOR CARRYING OUT THE INVENTION

In the following, the Ni based alloy material of the present invention will be described in detail. In the following description, the symbol "%" for the chemical composition of the Ni based alloy material represents "% by mass" if not otherwise specified.

(A) Chemical Composition

C: not more than 0.03%

C (carbon) combines with Cr contained in an alloy and precipitates on grain boundaries as Cr carbides, which contribute to an improvement of hardness in a temperature range of 100 to 500° C., in particular at 500° C. (hereafter, also referred to as "high temperature hardness"). However, if the content of C exceeds 0.03%, Cr depleted zones are formed in the vicinity of the grain boundaries. As a result, intergranular corrosion resistance deteriorates. Therefore, the content of C is set to be not more than 0.03%. The content of C is more preferably not more than 0.02%.

In order to ensure the above-described effect of C, the content of C is preferably not less than 0.002%.

Si: 0.01 to 0.5%

Si (silicon) is an essential element for not only obtaining a deoxidizing effect but also increasing oxidation resistance. For this reason, a content of Si not less than 0.01% should be included. However, Si segregates on the grain boundaries and reacts with combustion slag containing chlorides, causing intergranular corrosion. In addition, an excessive Si content of more than 0.5% deteriorates mechanical properties such as ductility and so on. Therefore, the content of Si is set to 0.01 to 0.5%. The content of Si is preferably not less than 0.1%. In addition, the content thereof is preferably not more than 0.4%.

Mn: 0.01 to 1.0%

Mn (manganese) is an austenite-forming element and has a deoxidizing effect. In addition, Mn combines with S contained in an alloy and forms MnS, which improves hot workability. In order to ensure these effects, a content of Mn not less than 0.01% is necessary. However, if the Mn content exceeds 1.0%, workability deteriorates contrarily, and moreover, weldability is also impaired. Therefore, the content of Mn is set to 0.01 to 1.0%. The content of Mn is preferably not less than 0.1%. In addition, the content thereof is preferably not more than 0.6%.

P: not more than 0.03%

P (phosphorus) is an impurity element coming from raw materials and so on. A high content of P impairs weldability and workability; in particular, when the content of P exceeds 0.03%, the deterioration of weldability and workability becomes remarkable. Therefore, the content of P is set to not more than 0.03%. The content of P is preferably not more than 0.015%.

S: not more than 0.01%

S (sulfur) is also an impurity element coming from raw materials and so on. A high content of S impairs weldability and workability; in particular, when the content of S exceeds 0.01%, the deterioration of weldability and workability becomes remarkable. Therefore, the content of S is set to not more than 0.01%. The content of S is preferably not more than 0.002%.

Cr: not less than 20% to less than 30%

Cr (chromium) has an effect of ensuring high temperature hardness and corrosion resistance at high temperatures. In order to obtain these effects, a content of Cr not less than 20% is necessary. However, in the case of environments in which Cr is not passivated, such as hydrochloric acid environment and so on, Cr readily dissolves compared to Fe and Ni. For this reason, at a high Cr content level, in particular, at a Cr content level of not less than 30%, Cr may deteriorate corrosion resistance contrarily; and moreover, the deterioration of weldability and workability occurs. Therefore, the content of Cr is set to not less than 20% to less than 30%. The content of Cr is preferably not less than 20%. In addition, the content thereof is preferably less than 25%.

Ni: more than 40% to not more than 50%

Ni (nickel) is an element which stabilizes the austenitic microstructure and is an essential element for ensuring corrosion resistance. However, if the content of Ni is not more than 40%, it is impossible to obtain the above-mentioned effect sufficiently. On the other hand, since Ni is an expensive element, at a high Ni content level, cost increases greatly; in particular, at a Ni content level of more than 50%, the effect of an improvement in corrosion resistance is small with respect to an increase of alloy cost, resulting in a very poor balance of "alloy cost to corrosion resistance". Therefore, the content of Ni is set to more than 40% to not more than 50%. The content of Ni is preferably not less than 42%. In addition, the content thereof is preferably less than 48%.

Cu: more than 2.0% to not more than 5.0%

Cu (copper) is an indispensable element in order to improve the corrosion resistance to both sulfuric acid and hydrochloric acid of the Ni based alloy material of the present invention. In addition, Cu also contributes to an improvement in high temperature hardness. In order to obtain such effects, a content of Cu more than 2.0% is necessary. However, even if Cu is contained at a level of more than 5%, not only the above-described effects do not become great so much, but also the deterioration of weldability and/or workability occurs contrarily. For this reason, the content of Cu is set to more than 2.0% to not more than 5.0%. The content of Cu is more preferably more than 2.5% and further more preferably more than 3.0%. The upper limit of the Cu content is preferably 4.5% and more preferably 4.0%.

Mo: 4.0 to 10%

Together with Cu, Mo (molybdenum) is an indispensable element in order to improve the corrosion resistance to both sulfuric acid and to hydrochloric acid of the Ni based alloy material of the present invention. In addition, Mo contributes also to an improvement in high temperature hardness. In order to obtain such effects, a content of Mo not less than 4.0% is necessary. However, an excessive content of Mo promotes the precipitation of sigma phase and causes the deterioration of weldability and workability; in particular, when the content of Mo exceeds 10%, the deterioration of weldability and workability becomes remarkable. Therefore, the content of Mo is set to 4.0 to 10%. The content of Mo is preferably not less than 4.5%. In addition, the content thereof is preferably not more than 8.0%. The content of Mo is more preferably not less than 5.0%. In addition, the content thereof is more preferably not more than 7.0%.

Al: 0.005 to 0.5%

In order to obtain a deoxidizing effect, it is necessary that the content of Al be not less than 0.005%. However, when Al is included at a content exceeding 0.5%, the above effect is saturated and the alloy cost increases. In addition, the deterioration of hot workability occurs. Therefore, the content of Al is set to 0.005 to 0.5%. The content of Al is preferably not less than 0.03%. In addition, the content thereof is preferably not more than 0.3%.

W: 0.1 to 10%

W (tungsten) has an effect of promoting solid solution hardening and work hardening without causing the deterioration of weldability and workability. In addition, W has an effect of increasing high temperature hardness, which makes it possible to easily ensure high temperature hardness, in particular a surface hardness of an HV hardness of 350 at 500° C. by applying cold working. In order to obtain these effects, a content of W not less than 0.1% is necessary. Incidentally, Cr and Mo promote the precipitation of sigma phase and cause the deterioration of weldability and workability. And therefore, it is also possible to prevent the deterioration of the weldability and workability due to the said precipitation of sigma phase caused by large contents of Cr and Mo by including W. However, in the case of W as well, when the content thereof increases, in particular, when it exceeds 10%, the deterioration of weldability and workability will be caused. Therefore, the content of W is set to 0.1 to 10%.

In order to ensure the above-described effects of W, the content of W is preferably not less than 0.2%. The content of W is preferably not less than 1.0%. In addition, the content thereof is preferably not more than 8.0%. Incidentally, the content of W is more preferably not more than 6.0%.

N: more than 0.10% to not more than 0.35%

N (nitrogen) is one of the elements which contributes to the stabilization of the austenitic microstructure and has an effect of solid solution hardening. In order to obtain these effects, it is necessary that the content of N be exceeding 0.10%. However, an excessive content of N promotes nitrides to increase in number and causes the deterioration of hot workability; in particular, when the content of N exceeds 0.35%, the deterioration of hot workability becomes remarkable. Therefore, the content of N is set to more than 0.10% to not more than 0.35%. The lower limit of the N content is preferably more than 0.15%, and the upper limit thereof is preferably 0.30%. In addition, the lower limit of the N content is more preferably more than 0.20%.

Even when the contents of C, Si, Mn, P, S, Cr, Ni, Cu, Mo, Al, W and N are in the above-described ranges, there may be cases where it is impossible to ensure excellent corrosion resistance to both sulfuric acid and hydrochloric acid. For this reason, it is necessary that the Ni based alloy material according to the present invention [1] satisfies the formula (1) in addition to the definition of the above-described ranges of content of each element;

$$0.5Cu+M \geq 6.5 \quad (1),$$

wherein, each element symbol in the above formula (1) represents the content by mass percent of the element concerned.

That is to say, when the contents of Cu and Mo are in the above-described ranges and further satisfy the above formula (1), it is possible to form passive films in a stable manner on the surfaces of the Ni based alloy material in the environments of sulfuric acid and hydrochloric acid; and therefore, it becomes possible to ensure excellent corrosion resistance against both sulfuric acid and hydrochloric acid.

The value of the left side of the above formula (1), that is to say, [0.5Cu+Mo] is preferably not less than 7.0. The upper limit of the value of the left side of the formula (1) may be 12.5, which is expected in the case where the Cu content and the Mo content are at their respective upper limits of 5.0% and 10%.

The balance of the Ni based alloy material according to the present invention [1] is composed of Fe and other impurity elements (which are components mixed into from raw materials such as ore and scrap and due to various factors in the manufacturing process when the Ni based alloy material is industrially manufactured, and which are permitted within a range not to adversely affect the present invention). That is to say, the main component of the balance of the present invention [1] is composed of Fe. In the following, this fact is explained.

Fe (iron) has the effect of ensuring the hardness of a Ni based alloy material and also reducing the content of Ni in order to decrease the cost of the alloy. For this reason, in the Ni based alloy material according to the present invention, it is defined that the balance is composed of Fe and impurities. The upper limit of the content of Fe, which is the main component of the balance, may have values close to 32.3%, which is expected in the case where the contents of Si, Mn, Cr, Ni, Cu, Al, W and N have respective values of the lower limits of the above-described ranges, the all of contents of C, P and S have values close to 0, and the Mo content has values close to 5.5% (that is to say, the value of the right side of the formula (1) mentioned above is 6.5).

The Ni based alloy material according to the present invention [1] has a chemical composition which consists of the elements from C to N in the above-described ranges, with the balance being Fe and impurities, and satisfies the above formula (1).

The Ni based alloy material of the present invention may further contain, in lieu of a part of Fe, according to need, one or more elements selected from Ca and Mg.

That is to say, Ca and Mg are elements which have an effect of improving the hot workability. Therefore, in order to obtain this effect, the above elements may be included in the Ni based alloy material of the present invention. The above-described Ca and Mg will be explained below.

Ca: not more than 0.01%

Ca (calcium) has an effect of improving the hot workability. However, a Ca content which exceeds 0.01% impairs mechanical properties such as toughness and so on, since the cleanliness of the alloy decreases remarkably. For this reason, when Ca is included, the content of Ca is set to not more than 0.01%. When Ca is included, the content of Ca is preferably not more than 0.005%.

On the other hand, when Ca is included, in order to ensure the above-described effect of Ca, the content of Ca is preferably not less than 0.0005%.

Mg: not more than 0.01%

Mg (magnesium) also has an effect of improving the hot workability. However, a Mg content which exceeds 0.01% impairs mechanical properties such as toughness and so on, since the cleanliness of the alloy decreases remarkably. For this reason, when Mg is included, the content of Mg is set to not more than 0.01%. When Mg is included, the content of Mg is preferably not more than 0.005%.

On the other hand, when Mg is included, in order to ensure the above-described effect of Mg, the content of Mg is preferably not less than 0.0005%.

The above-described Ca and Mg, may be included singly as only either of these elements or compositely as both elements. If these elements are included, the total content thereof is preferably not more than 0.015%.

From the reasons described above, the chemical composition of the Ni based alloy material according to the present invention [2] is determined as the one which further contains one or more elements selected from Ca: not more than 0.01% and Mg: not more than 0.01% in lieu of a part of Fe in the Ni based alloy material according to the present invention [1].

(B) High Temperature Hardness of Surface

The Ni based alloy material of the present invention must have a surface hardness of an HV hardness of not less than 350 at 500° C. This is because having a surface hardness of an HV hardness of not less than 350 at 500° C. allows the restriction of thickness reduction due to erosion by combustion ashes and so on. The HV hardness at 500° C. is preferably set to not less than 380. On the other hand, since there is concern about the occurrence of stress corrosion cracking, the HV hardness at 500° C. is preferably set to not more than 600. In order to restrict the thickness reduction in the Ni based alloy material of the present invention due to erosion, at least the surface which is affected by combustion ashes and so on needs only have an HV hardness of not less than 350 at 500° C., and the internal hardness may be below an HV hardness of 350 provided that necessary properties can be achieved.

The Ni based alloy materials according to the present invention [1] and the present invention [2] can be manufactured and formed into desired shapes, such as not only plates, but also seamless tubes and pipes, welded tubes and pipes, further bars and so on, by using means such as melting, casting, hot working, cold working, welding and so on.

That is to say, for example, the Ni based alloy material of the present invention can be manufactured, with the alloy having the chemical composition described in the said item (A) as the raw material by cold rolling in the case of plates, and by cold rolling, cold drawing and the like in the case of tubes and pipes. In addition, the manufacturing can be conducted by performing processing such as shot peening, straightening and so on.

When performing cold working such as rolling and drawing with an alloy having the chemical composition described in the said item (A) as the raw material, if the reduction of area is not less than 1%, it is possible to obtain a surface hardness of an HV hardness of not less than 350 at 500° C. If the reduction of area is not less than 2%, it is possible to obtain a surface hardness of an HV hardness of not less than 350 at 500° C. in a more reliable and stable manner; and therefore, a preferable lower limit of the reduction of area is 2%. On the other hand, if the reduction of area is too large, there is concern about the occurrence of stress corrosion cracking; and therefore, the reduction of area is preferably not more than 5%. The "reduction of area" in the unit of percent can be determined by the following formula (2):

$$\{(\text{cross sectional area before working} - \text{cross sectional area after working})/\text{cross sectional area before working}\} \times 100 \quad (2).$$

The following examples illustrate the present invention more specifically. These examples are, however, by no means limited to the scope of the present invention.

EXAMPLES

Various Ni based alloys having the chemical compositions shown in Table 1 were melted using a high-frequency heating vacuum furnace, and plates having a thickness of 15 mm were obtained by usual methods, namely, by performing a hot forging, a hot rolling and a cold rolling. After such treatments, the said plates were subjected to a solid solution heat treatment at 1150° C., and further to a cold rolling so as to have values of reduction of area as shown in Table 2; and thereafter, specimens having a thickness of 2 mm, a width of 10 mm and a length of 50 mm were cut out from each plate with one surface thereof being left. Incidentally, after the said solid solution heat treatment, the plate of alloy 15 was not subjected to cold rolling.

The alloys 1 to 5 and 15 in Table 1 are Ni based alloys having chemical compositions which fall within the range regulated by the present invention. On the other hand, the alloys 6 to 14, 16 and 17 are Ni based alloys of comparative examples in which any one of the elements is out of the conditions regulated by the present invention, or did not satisfy the formula (1). Among the Ni based alloys of the comparative examples, the alloy 6 and the alloy 7 are Ni based alloys correspond to Hastelloy C276 and Hastelloy C22, respectively.

TABLE 1

| Alloy | Chemical composition (% by mass) Balance: Fe and impurities | | | | | | | | | | | | | | |
|---|---|---|---|---|---|---|---|---|---|---|---|---|---|---|---|
| No. | C | Si | Mn | P | S | Cu | Ni | Cr | Mo | Al | N | W | Ca | Mg | Left side of formula (1) |
| 1 | 0.007 | 0.17 | 0.39 | 0.003 | 0.0007 | 2.12 | 42.30 | 23.00 | 9.02 | 0.045 | 0.332 | 0.30 | — | — | 10.08 |
| 2 | 0.005 | 0.19 | 0.23 | 0.003 | 0.0006 | 3.01 | 45.83 | 28.83 | 5.87 | 0.078 | 0.244 | 6.37 | — | — | 7.38 |
| 3 | 0.006 | 0.20 | 0.30 | 0.004 | 0.0007 | 3.52 | 48.79 | 22.73 | 5.02 | 0.080 | 0.212 | 2.59 | — | — | 6.78 |
| 4 | 0.008 | 0.18 | 0.23 | 0.003 | 0.0006 | 4.01 | 46.15 | 22.71 | 5.38 | 0.084 | 0.119 | 3.77 | 0.0005 | 0.0008 | 7.39 |
| 5 | 0.007 | 0.15 | 0.22 | 0.005 | 0.0004 | 4.87 | 46.35 | 21.35 | 4.45 | 0.085 | 0.143 | 2.87 | 0.0019 | — | 6.89 |
| 6 | 0.002 | 0.07 | 0.41 | 0.008 | 0.0002 | *0.13 | *57.95 | *15.40 | *15.65 | 0.210 | *0.003 | 3.38 | — | — | 15.72 |
| 7 | 0.003 | 0.04 | 0.11 | 0.006 | 0.0002 | *0.15 | *58.35 | 21.00 | *13.49 | 0.190 | *0.010 | 2.71 | — | — | 13.57 |
| 8 | 0.008 | 0.11 | 0.41 | 0.008 | 0.0002 | *1.29 | 43.21 | 24.39 | 5.53 | 0.210 | 0.231 | 0.87 | — | — | * 6.18 |
| 9 | 0.005 | 0.08 | 0.11 | 0.006 | 0.0002 | 3.22 | *38.21 | 21.39 | 5.12 | 0.190 | 0.192 | 1.53 | — | — | 6.73 |
| 10 | 0.009 | 0.23 | 0.41 | 0.001 | 0.0010 | 2.89 | 42.89 | *18.93 | 5.39 | 0.061 | 0.213 | 0.35 | 0.0020 | — | 6.84 |
| 11 | 0.008 | 0.21 | 0.42 | 0.001 | 0.0010 | 2.34 | 44.75 | 27.52 | *3.82 | 0.064 | 0.226 | 0.50 | 0.0019 | — | * 4.99 |
| 12 | 0.007 | 0.22 | 0.42 | 0.001 | 0.0010 | 4.02 | 48.21 | 26.98 | 6.12 | 0.057 | 0.110 | *0.01 | 0.0021 | — | 8.13 |
| 13 | 0.006 | 0.18 | 0.23 | 0.003 | 0.0006 | 3.91 | 42.59 | 25.77 | 5.32 | 0.093 | *0.078 | 0.40 | — | — | 7.28 |
| 14 | 0.005 | 0.17 | 0.39 | 0.003 | 0.0006 | *1.52 | 43.22 | 27.82 | 4.79 | 0.046 | 0.188 | 0.39 | — | 0.0005 | * 5.55 |
| 15 | 0.006 | 0.21 | 0.21 | 0.005 | 0.0007 | 3.29 | 43.59 | 27.03 | 5.99 | 0.082 | 0.194 | 0.12 | 0.0009 | — | 7.64 |
| 16 | 0.008 | 0.18 | 0.20 | 0.004 | 0.0009 | 2.41 | 46.03 | 22.81 | 5.09 | 0.079 | *0.063 | 0.41 | 0.0008 | — | * 6.30 |
| 17 | 0.007 | 0.17 | 0.22 | 0.016 | 0.0004 | 2.94 | 46.95 | 22.70 | 4.90 | 0.085 | 0.152 | 2.56 | 0.0043 | — | * 6.37 |

Left side of formula (1): 0.5Cu + Mo

The mark * indicates falling outside the conditions regulated by the present invention.

TABLE 2

| Classification | Test No. | Alloy No. | Reduction of area in cold rolling (%) | HV hardness at 500° C. | Corrosion resistance to hydrochloric acid [corrosion rate] (mm/y) | Corrosion resistance to sulfuric acid [corrosion rate] (mm/y) |
|---|---|---|---|---|---|---|
| Inventive example | 1 | 1 | 3.2 | 401 | 0.02 | 0.01 |
| | 2 | 2 | 4.7 | 387 | 0.04 | 0.01 |
| | 3 | 3 | 2.8 | 361 | 0.05 | 0.03 |
| | 4 | 4 | 3.9 | 398 | 0.04 | 0.02 |
| | 5 | 5 | 4.2 | 403 | 0.03 | 0.02 |
| Comparative example | 6 | * 6 | 3.9 | # 298 | 0.03 | 0.06 |
| | 7 | * 7 | 3.7 | # 287 | 0.02 | 0.03 |
| | 8 | * 8 | 4.3 | 368 | 1.21 | 0.66 |
| | 9 | * 9 | 4.0 | 377 | 0.58 | 0.23 |
| | 10 | * 10 | 4.1 | 357 | 0.41 | 0.12 |
| | 11 | * 11 | 3.8 | # 311 | 1.72 | 0.69 |
| | 12 | * 12 | 3.9 | # 298 | 0.09 | 0.04 |
| | 13 | * 13 | 4.1 | # 306 | 0.08 | 0.03 |
| | 14 | * 14 | 4.2 | 368 | 1.81 | 0.81 |

TABLE 2-continued

| Classification | Test No. | Alloy No. | Reduction of area in cold rolling (%) | HV hardness at 500° C. | Corrosion resistance to hydrochloric acid [corrosion rate] (mm/y) | Corrosion resistance to sulfuric acid [corrosion rate] (mm/y) |
|---|---|---|---|---|---|---|
| | 15 | 15 | — | # 210 | 0.05 | 0.01 |
| | 16 | * 16 | 3.2 | # 312 | 1.47 | 0.02 |
| | 17 | * 17 | 3.9 | 356 | 1.63 | 0.03 |

The mark "—" in the column of "Reduction of area in cold rolling" indicates that cold rolling was not performed.

In the columns of "Corrosion resistance to hydrochloric acid" and "Corrosion resistance to sulfuric acid", each reduced mass was measured from the mass differences before and after the test, and each corrosion rate was calculated.

The mark * and # indicate falling outside the conditions of chemical composition and HV hardness regulated by the present invention respectively.

The thus obtained 2 mm thick specimens of each Ni based alloy were kept at 500° C. for three minutes, and thereafter used to measure the surface Vickers hardness at 500° C. according to JIS Z 2252 (1991) and its related standard JIS Z 2244 (2009) with a test force of 98.07 N, respectively. Furthermore, the said specimens were tested by immersing in 10.5 mass % of hydrochloric acid at 80° C. for 6 hours, and in 70 mass % of sulfuric acid at 100° C. for 24 hours, respectively.

The deposits on the surfaces of the specimens after the immersion in the above hydrochloric acid were removed, and thereafter, each reduced mass was measured from the mass differences before and after the test, and each corrosion rate was calculated to evaluate the corrosion resistance to hydrochloric acid.

Similarly, the deposits on the surfaces of the specimens after the immersion in the above sulfuric acid were removed, and thereafter, each reduced mass was measured from the mass differences before and after the test, and each corrosion rate was calculated to evaluate the corrosion resistance to sulfuric acid.

The measurement results of HV hardness of the surface at 500° C. and the investigation results of the corrosion resistance to both hydrochloric acid and sulfuric acid are shown in Table 2.

From Table 2, it is apparent that in the case of Test Nos. 1 to 5 of the inventive examples in which the Ni based alloys 1 to 5 satisfying the conditions regulated by the present invention were used, the excellent corrosion resistance (that is to say, excellent corrosion resistance to both sulfuric acid and hydrochloric acid) were obtained; namely, the excellent corrosion resistance being equivalent to that of Test Nos. 6 and 7 in which Hastelloy C276 and Hastelloy C22, respectively were used, were obtained. In addition, in the case of Test Nos. 1 to 5, the HV hardness at 500° C. ranged from 361 to 403; and therefore, it is also apparent that the excellent erosion resistance was obtained respectively.

On the contrary, in the case of Test Nos. 8 to 11, 14, 16 and 17, the corrosion rate in at least either hydrochloric acid or sulfuric acid increased, and thus it is apparent that the corrosion resistance thereof was inferior.

That is to say, when the contents of Cu and Mo of used alloys 8, 11, 14, 16 and 17 do not satisfy the formula (1), it is apparent that in both the Ni based alloys in which the content range of each element does not satisfy the range regulated by the present invention (Test Nos. 8, 11, 14 and 16) and that in which the content range of each element satisfies the regulated range (Test No. 17), the corrosion rate in at least either hydrochloric acid or sulfuric acid increased compared to Test Nos. 6 and 7, in which Hastelloy C276 and Hastelloy C22 were used respectively; and therefore, it is apparent that the corrosion resistance thereof was inferior.

In the case of Test No. 9 in which the used alloy 9 has the Ni content less than the value regulated by the present invention, the corrosion rate in hydrochloric acid increased; and therefore, the corrosion resistance thereof was inferior.

Furthermore, in the case of Test No. 10 in which the used alloy 10 has the Cr content less than the value regulated by the present invention, the corrosion rate in hydrochloric acid increased; and therefore, the corrosion resistance thereof was also inferior.

In the case of Test Nos. 11 to 13 and 16, the alloys 11 to 13 and 16, in which the content of any one of the elements among Mo, N and W having an effect of improving hardness is out of the range regulated by the present invention, are used and each HV hardness at 500° C. did not reach 350 as in the case of Test Nos. 6 and 7, in which Hastelloy C276 and Hastelloy C22 were used respectively; and therefore, it is apparent that the erosion resistance thereof was inferior.

In the case of Test No. 15, although the chemical composition of used alloy 15 satisfies the conditions regulated by the present invention, the HV hardness at 500° C. was 210 which being further lower than those in the case of Test Nos. 6 and 7, in which Hastelloy C276 and Hastelloy C22 were used respectively. Therefore, it is apparent that the erosion resistance thereof was inferior.

On the Ni based alloys 1 to 5 which satisfy the conditions regulated by the present invention, a high temperature tensile test was separately conducted by using a thermorester testing machine to investigate the hot workability. As a result, it was ascertained that the hot workability thereof is good.

INDUSTRIAL APPLICABILITY

The Ni based alloy material of the present invention has a corrosion resistance equivalent to that of Ni based alloys having high Mo contents, such as Hastelloy C22 and Hastelloy C276, in a severe environment where hydrochloric acid corrosion and sulfuric acid corrosion occur, together with excellent workability. Further, the Ni based alloy material also has an excellent erosion resistance since it has a high surface hardness owing to the solid solution hardening of N and cold working. For this reason, the said Ni based alloy material can be suitably used as a low-cost material for various kinds of structural members, such as those of economizers of heavy oil fired boilers as well as those of flue gas desulfurization equipment, flues, smokestacks and the like in thermal power stations.

What is claimed is:

1. A Ni based alloy material, having a chemical composition which consists of by mass percent, C: not more than 0.03%, Si: 0.01 to 0.5%, Mn: 0.01 to 1.0%, P: not more than 0.03%, S: not more than 0.01%, Cr: not less than 20% to less than 30%, Ni: more than 40% to not more than 50%, Cu: 3.52 to 5.0%, Mo:

4.0 to 10%, Al: 0.005 to 0.5%, W: 0.1 to 10% and N: more than 0.10% to not more than 0.35%, with the balance being Fe and impurities, and the following formula is satisfied, $$0.5Cu+M \geq 6.5 \quad (1);$$

and further, having a surface hardness of a Vickers hardness of not less than 350 at 500° C.;

wherein, each element symbol in the formula (1) represents the content by mass percent of the element concerned.

2. A Ni based alloy material, having a chemical composition which consists of by mass percent, C: not more than 0.03%, Si: 0.01 to 0.5%, Mn: 0.01 to 1.0%, P: not more than 0.03%, S: not more than 0.01%, Cr: not less than 20% to less than 30%, Ni: more than 40% to not more than 50%, Cu: 3.52 to 5.0%, Mo: 4.0 to 10%, Al: 0.005 to 0.5%, W: 0.1 to 10%, N: more than 0.10% to not more than 0.35% and one or more elements selected from Ca: not more than 0.01% and Mg: not more than 0.01%, with the balance being Fe and impurities, and the following formula is satisfied, $$0.5Cu+M \geq 6.5 \quad (1);$$

and further, having a surface hardness of a Vickers hardness of not less than 350 at 500° C.;

wherein, each element symbol in the formula (1) represents the content by mass percent of the element concerned.

* * * * *